US005244682A

United States Patent [19]

Happ

[11] Patent Number: 5,244,682

[45] Date of Patent: Sep. 14, 1993

[54] COOKING APPARATUS AND PROCESS FOR COOKING FOOD THEREWITHIN

[75] Inventor: Thomas W. Happ, Boswell, Ind.

[73] Assignee: AB Specialty Packaging, Inc., Hialeah, Fla.

[21] Appl. No.: 794,996

[22] Filed: Nov. 19, 1991

[51] Int. Cl.[5] ..... B65B 25/00

[52] U.S. Cl. ..... 426/107; 219/10.55 E; 219/10.55 M; 426/111; 426/113; 426/234

[58] Field of Search ..... 426/392, 107, 111, 113, 426/234; 219/10.55 E, 10.55 M

[56] References Cited

U.S. PATENT DOCUMENTS

| | | | |
|---|---|---|---|
| 3,835,280 | 9/1974 | Gades et al. | 219/10.55 R |
| 3,851,574 | 12/1974 | Katz et al. | 426/107 |
| 3,973,045 | 8/1976 | Brandberg et al. | 426/110 |
| 4,132,811 | 1/1979 | Standing et al. | 426/107 |
| 4,553,010 | 11/1985 | Bohrer et al. | 219/10.55 E |
| 4,678,882 | 7/1987 | Bohrer et al. | 219/10.55 E |
| 4,735,513 | 4/1988 | Watkins | 383/116 |
| 4,878,765 | 11/1989 | Watkins | 383/116 |

*Primary Examiner*—George Yeung

*Attorney, Agent, or Firm*—Dick and Harris

[57] ABSTRACT

A cooking apparatus and process for cooking food therewithin, wherein the apparatus facilitates cooking of various types of food in cooking containers, in which at least minimal agitation of the food to be cooked is desired, and wherein the food, as well as the apparatus may be expandable during the cooking process. A food containment region is provided for acceptance of the food to be cooked prior to operably sealing the cooking container. Container positioning portions are operably associated with at least a section of the cooking container so as to temporarily maintain the cooking container in a vertically supported orientation after insertion of the apparatus within an oven. The container positioning portions change position relative to the cooking container after a predetermined period of exposure to heat and cooking generated from the oven so as to cause gravitational movement of the cooking container from its vertically supported orientation to a fallen orientation, wherein such falling causes agitation to the food containment region for enhanced cooking uniformity and quality.

26 Claims, 2 Drawing Sheets

Fig 13
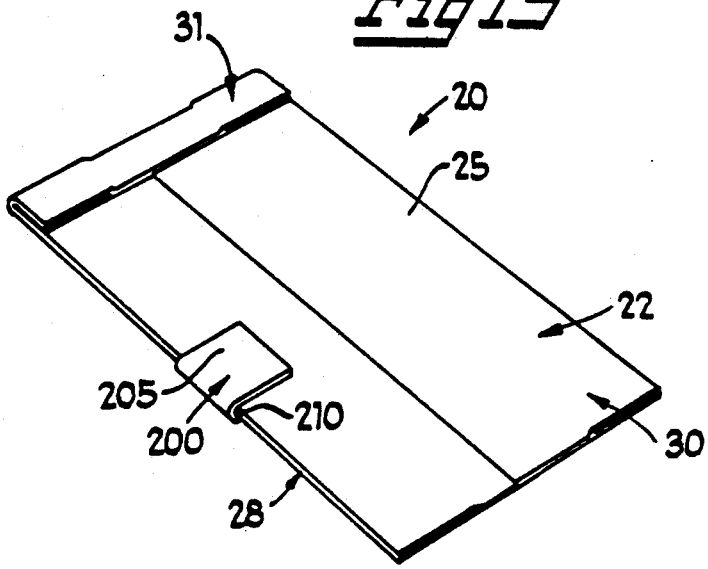
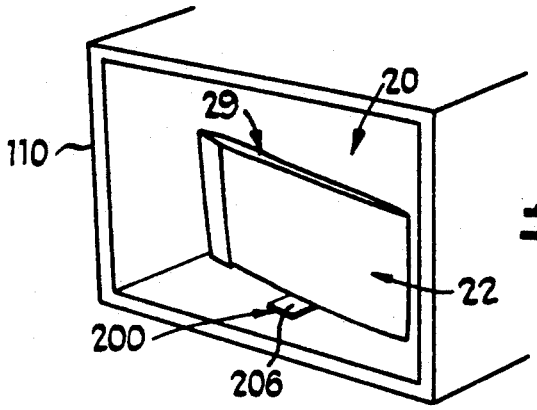
Fig 14
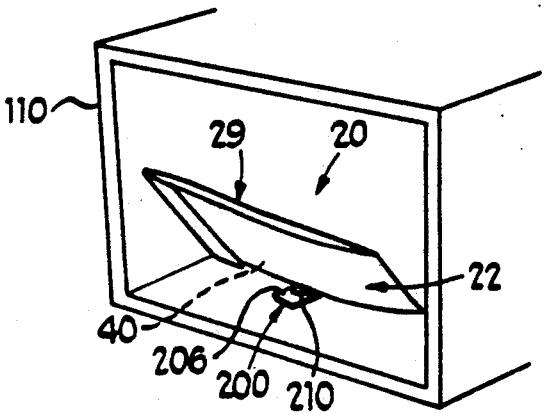
Fig 15

COOKING APPARATUS AND PROCESS FOR COOKING FOOD THEREWITHIN

BACKGROUND OF THE INVENTION

The present invention relates in general to containers used for cooking food in an oven, and, more particularly, to a cooking apparatus container, and, a process for filling and cooking food therewithin, wherein it is preferable that the food intended to be cooked be agitated during the cooking process so as to enhance cooking uniformity and cooking quality.

Containers for cooking food in an oven, whether it be a conventional oven or a microwave oven, have been known in the art for many years. Indeed, many of such containers have incorporated a food containment region which not only serves to house the food to be cooked during the cooking process, but which is also capable of expansion as the result of internal pressure built up therewithin during extended exposure of heat generated from the oven, and, in turn from the heat generated from the food being cooked within the food containment region. Furthermore, it is also known in the art that such containers can be constructed with gusseted side panels which further increase the expandable area of the cooking container, and more particularly, the food containment region, during cooking. An example of such prior art can be found in U.S. Pat. No. 3,973,045, to Brandberg et al., for a Popcorn Package For Microwave Popping—wherein a bag having gusseted sides expands during the cooking process. Other prior art containers include the following U.S. Patents: Bohrer, U.S. Pat. Nos. 4,553,010, and 4,678,882; Watkins et al., U.S. Pat. Nos. 4,735,513 and 4,878,765; Gades, U.S. Pat. No. 3,835,280; and, Katz U.S. Pat. No. 3,851,574.

Few, if any prior art containers provide container positioning means to enable temporary positioning of the cooking container in a first vertically supported orientation within the oven during the beginning stages of the cooking process. Furthermore, few, if any, of such prior art devices additionally disclose any ability for the controlled transition of the cooking container from its first vertically supported orientation to a second fallen orientation, wherein such falling results after a predetermined period of exposure of the container positioning means to the heat generated from the oven during cooking food, prior to completion of the cooking process, wherein such falling causes agitation of the food to be cooked within the food containment region for purposes of enhancing cooking uniformity and cooking quality.

Additionally, while the prior art does disclose gusseted side panels, such side panels are specifically intended for unrestricted expansion during the cooking process. Accordingly, the prior art teaches away from temporarily hindering expansion of the gusseted side panels during the initial stages of the cooking process until only after the cooking container has fallen from its first vertically supported orientation to its second fallen orientation, wherein such hindrance is overcome prior to completion of the cooking process.

It is thus an object of the present invention to provide a cooking apparatus which can be temporarily maintained in a first vertically supported orientation upon insertion of the apparatus into an oven, wherein such vertical support will be maintained until a predetermined amount of exposure of heat generated from the oven has occurred, and accordingly, only after partial cooking of the food and/or heating of any container support means.

It is also an object of the present invention to provide a cooking apparatus which will fall from gravity from its first vertically supported orientation to a second fallen orientation only after food within the food containment region has been partially cooked a predetermined amount and/or until alteration of any container support means, and, wherein the gravitational fall causes agitation to the cooking food—for purposes of enhancing overall cooking uniformity and quality.

It is still further an object of the present invention to provide a cooking apparatus which has releasable pinched gusseted regions which temporarily hinder expansion of the gusseted side panels during initial cooking of the food within the food containment region so as to facilitate the transition of the cooking container from its first vertically supported orientation toward and into a second fallen orientation, and, wherein full release of the pinched portion does not occur until after the cooking container has fallen—prior to completion of the cooking process.

It is yet another object of the present invention to provide a cooking apparatus which can cook various types of food which are intended to expand during the cooking process, as well as food that does not expand.

These and other objects of the present invention will become apparent in light of the present specification and drawings.

SUMMARY OF THE INVENTION

The present invention comprises a cooking apparatus for facilitating the cooking of various types of foods in which at least minimal facilitated agitation of the food is desired during cooking, and, wherein the food is cooked in the cooking apparatus on an oven bottom support, responsive to heat generated from an oven, such as a conventional or microwave oven.

The apparatus includes cooking container means which have a longitudinal axis, a transverse axis which is substantially normal thereto, front panel means, back panel means, first side means and second side means which are positioned substantially opposite to the first side means. The first and second side means are each operably positioned adjacent to the front and back panel means, and the cooking container means are operably configured to accept and retain food which is to be cooked therewithin during exposure to the generated heat. The front and back panel means, as well as the first and second side means each have an exterior surface, an interior surface which collectively define a food containment region, and a top and bottom end. Each of the bottom ends are operably configured so as to form a substantially sealed bottom region, while each of the top ends are operably attached to each other so as to form a substantially sealed top region. Accordingly, the food to be cooked is positioned within a portion of the food containment region prior to actually sealing one or both of the bottom and top regions.

Container positioning means are operably associated with the cooking container means for releasably maintaining the cooking container means in a first vertically supported orientation within the oven, and for alternatively releasing the cooking container means from the first vertically supported orientation to a second fallen orientation within the oven during cooking. The container positioning means are capable of releasing the cooking container from the first vertically supported orientation to the second fallen orientation as a function of heating, and/or cooking generated by the oven, without manual manipulation of the cooking container means during such cooking.

The container positioning means includes position release means for facilitating gravitational movement of the cooking container means from the first vertically supported orientation to the second fallen orientation upon a desired degree of exposure of the position release means to the heat generated from the oven. The gravitational movement of the cooking container means from the first vertically supported orientation to the second fallen orientation causes agitation to the food which is located within the food containment region.

In one preferred embodiment of the invention, the container positioning means comprises at least one fold means operably positioned along the longitudinal axis of one or more portions of the cooking container means. The at least one fold means are positioned substantially parallel to the transverse axis, so as to maintain the cooking container means in the first vertically supported orientation during at least a desired portion of the cooking. The folded portions of the cooking container means actually support the cooking container in its first vertically supported orientation.

The food containment region and, in turn, the cooking container means, expands and unfolds as the result of internal pressure generated within the food containment region during the cooking of the food therewithin, as the food is heated and cooked by the heat generated from the oven. The expansion of the food containment region causes the folded portions to be prompted into an unfolded position, in substantially co-planar alignment with the remaining portion of the cooking container means, to in turn, cause the cooking container means to fall by gravity, from its first vertically supported orientation to its second fallen orientation. The movement caused from the fall serves to cause agitation to the food within the food containment region for improved continued cooking thereof.

Also in this preferred embodiment of the invention, the first vertically supported orientation comprises at least a folded portion of one of the first and second side means being positioned in uprighted abutment with the bottom support of the oven. The second fallen orientation comprises at least a portion of one of the front and back panel means being positioned juxtaposed to the bottom support of the oven.

In one embodiment of the invention, the at least one fold means comprises two distally spaced folds along the longitudinal axis of the cooking container means so as to configure the cooking container means into a substantially Z-shaped cooking apparatus.

In another embodiment of the invention, the at least one fold means comprises at least two distally spaced folds along the longitudinal axis of the cooking container means so as to configure the cooking container means into a substantially U-shaped cooking apparatus.

In yet another embodiment of the invention, the at least one fold means comprises one fold along the longitudinal axis of the cooking container means so as to configure the cooking container means into a substantially L-shaped cooking apparatus.

In one preferred embodiment of the invention, the first and second side means comprise gusseted side panels for further facilitating expansion of the food containment region and the containment of an expanded food quantity therewithin. The gusseted side panels are temporarily hindered from over expansion as the result of one or more of them comprising pinched gusseted regions which are operably positioned along at least one of the first and second side panels. Such hindered expansion actually facilitates the transition of the cooking container means from the first vertically supported orientation to the second fallen orientation.

The pinched gusseted regions include gusset attachment means for releasably maintaining the one or more pinched gusseted regions in a substantially narrow orientation to facilitate the gravitational movement to the second fallen orientation. These pinched gusseted regions release upon extended exposure to the heat generated from the oven, as well as from food cooking within the food containment region after the cooking container means has fallen to the second fallen orientation, to facilitate expansion of the cooking container means after repositioning of same to the second fallen orientation. The releasable gusseted attachment means may comprise one or more adhesive spots which are operably positioned between a portion of the innermost faces of the gusseted panels for temporarily maintaining the pinched gusseted regions in the substantially narrow orientation.

In another preferred embodiment of the invention, the container positioning means comprise one or more support members operably attached to at least one of the first side means, the second side means, the front panel means and/or the back panel means of the cooking container means so as to facilitate temporary substantially vertical support of the cooking container means in its first vertically supported orientation within the oven.

The one or more support members comprise a wing-like member, and the position release means additionally comprise failure inducement means which are operably applied to the one or more wing-like members so as to cause the one or more wing-like members to at least partially detach from the cooking container means to enable the cooking container means to fall from its first vertically supported orientation to its second fallen orientation, wherein the movement of falling causes agitation to the food within the food containment region as a result of heat and/or cooking generated from the oven.

The position release means comprise fallible adhesive means which are operably applied between the one or more wing-like members and at least one of the first side means, the second side means, the front panel means and/or the back panel means. The adhesive means operably fail through either dissipation, melting and/or evaporation of the adhesive, and/or by forced displacement of the container means from the wing-like member due to the extended exposure of the adhesive means to the heat generated from the oven, often coupled with the expansion of the food containment region. Accordingly, such extended exposure causes the cooking container means to at least partially detach from the one or more wing-like members to, in turn, fall as the result of gravity from the first vertically supported orientation to the second fallen orientation. The first vertically supported orientation comprises at least a portion of one of the first and second side means being positioned juxtaposed to the bottom support of the oven, and, the second fallen orientation comprises at least a portion of one of the front and back panel means being juxtaposed to the bottom support of the oven.

In one embodiment of the invention, the cooking container means further includes inner container liner means which are operably positioned for exposure to the food containment region so as to preclude moisture and grease absorption by the remaining one or more plies of the cooking container means.

In another embodiment of the invention, the cooking container means includes a second outer ply and the inner container liner means is positioned adjacent to the food containment region, wherein the second outer ply comprises kraft paper and the inner container liner means comprises a substantially greaseproof material. In this embodiment of the invention, the inner container liner means and the second outer ply are laminated to each other along the first side means, the second side means, the front panel means and the back panel means. It is also contemplated that the container means be constructed from twenty-five pound greaseproof material.

The invention includes the process for preparing the cooking apparatus and for cooking with same in which the food is placed within a cooking container of the type having a transverse axis, a longitudinal axis, front and back panels, first and second sides which are operably attached to the front and back panels, a substantially sealable bottom region, a substantially sealable top region, an exterior surface, an interior surface defined by the front and back panels and the first and second sides to describe a food containment region in which the food to be cooked is placed prior to actual cooking. In this process one or more positioning regions are operably applied to at least a portion of the cooking apparatus for facilitating the cooking of food which ideally requires some agitation during the cooking process to enhance the overall uniformity and quality of the food so cooked. The process includes the steps of a) filling the cooking container with food prior to actually sealing the top region, so that the food can be operably positioned within the food containment region; b) sealing the top and bottom region of the cooking container so as to preclude the inadvertent release of the food during cooking; c) positioning one or more folds perpendicular to the longitudinal axis of the cooking container, so as to enable the cooking container to be positioned in an upright vertically supported first orientation within the oven prior to actual cooking; d) inserting the cooking container within the oven in the first vertically supported orientation; e) applying heat to the cooking container, and in turn, to the food contained therewithin, while the cooking container is in its first vertically supported orientation; f) allowing the heat to cause expansion of the food containment region, and in turn, the cooking food, if desired, so as to force the one or more folds into a substantially straight co-planar orientation resulting from said unfolding; g) permitting the cooking container to fall from the first vertically supported orientation towards and into a fallen orientation after the unfolding of the one or more folds, wherein the falling results from gravity, so as to cause agitation to the food cooking within the food containment region, to in turn, enhance substantial uniformity and quality of the food so cooked; h) allowing the heat to cause further expansion of the food containment region, and further expansion of the food being cooked, if desired; and i) removing the cooking container, and in turn, the cooking food from the oven.

In the preferred embodiment of the process, the step of inserting the cooking container within the oven further includes the step of utilizing a cooking container having gusseted side panels so as to enable increased expansion of the food containment region during the cooking process. The gusseted side panels are tacked, or pinched together at various portions prior to the step of inserting the cooking container into the oven, so as to temporarily maintain a relatively thin gusseted side panel profile, to in turn, facilitate the transition of the cooking container from the first vertically supported orientation to the second fallen orientation after unfolding of the one or more folds. These pinched regions are then prompted apart during the expansion of the food containment region only after the cooking container has fallen into its second fallen orientation.

In this preferred embodiment of the invention, the step of positioning one or more folds perpendicular to the longitudinal axis of the cooking container comprises the step of positioning one fold near the sealed bottom region, and a second fold near the sealed top region so as to form a substantially Z-shaped cooking apparatus.

In another embodiment, the process of positioning one or more folds perpendicular to the longitudinal axis of the cooking container comprises the step of positioning at least two folds so as to form a substantially U-shaped cooking apparatus.

In yet another embodiment, the step of positioning one or more folds perpendicular to the longitudinal axis of the cooking container comprises the step of positioning one fold so as to form a substantially L-shaped cooking apparatus.

BRIEF DESCRIPTION OF THE DRAWINGS

FIG. 13 of the drawings is a top perspective view of the cooking apparatus, showing in particular, a non-deployed wing-like positioning means operably attached to a portion of the first gusseted side panel of the cooking container means, as well as the adhesive used for attachment thereto;

FIG. 14 of the drawings is an elevated perspective view of the cooking apparatus of FIG. 13 within an oven, showing, in particular, the wing-like positioning means after it has been manually unfolded and deployed, to in turn, temporarily prop the cooking container means up into a vertically supported orientation; and FIG. 15 of the drawings is an elevated perspective view of the cooking apparatus within an oven, during cooking, showing in particular, the failure of the adhesive used to attach the wing-like positioning means to the cooking container means, wherein such failure had been caused by a predetermined amount of exposure of heat generated from the oven, as well as showing the cooking container means falling as the result of gravity from its vertically unsupported orientation towards a fallen orientation—as a result of failure of the adhesive between the wing-like positioning means and the cooking container means.

DETAILED DESCRIPTION OF THE DRAWINGS

Figures 1, 2, 3, 4, 5, 6, 7, 8, 9, 10, 11, 12:
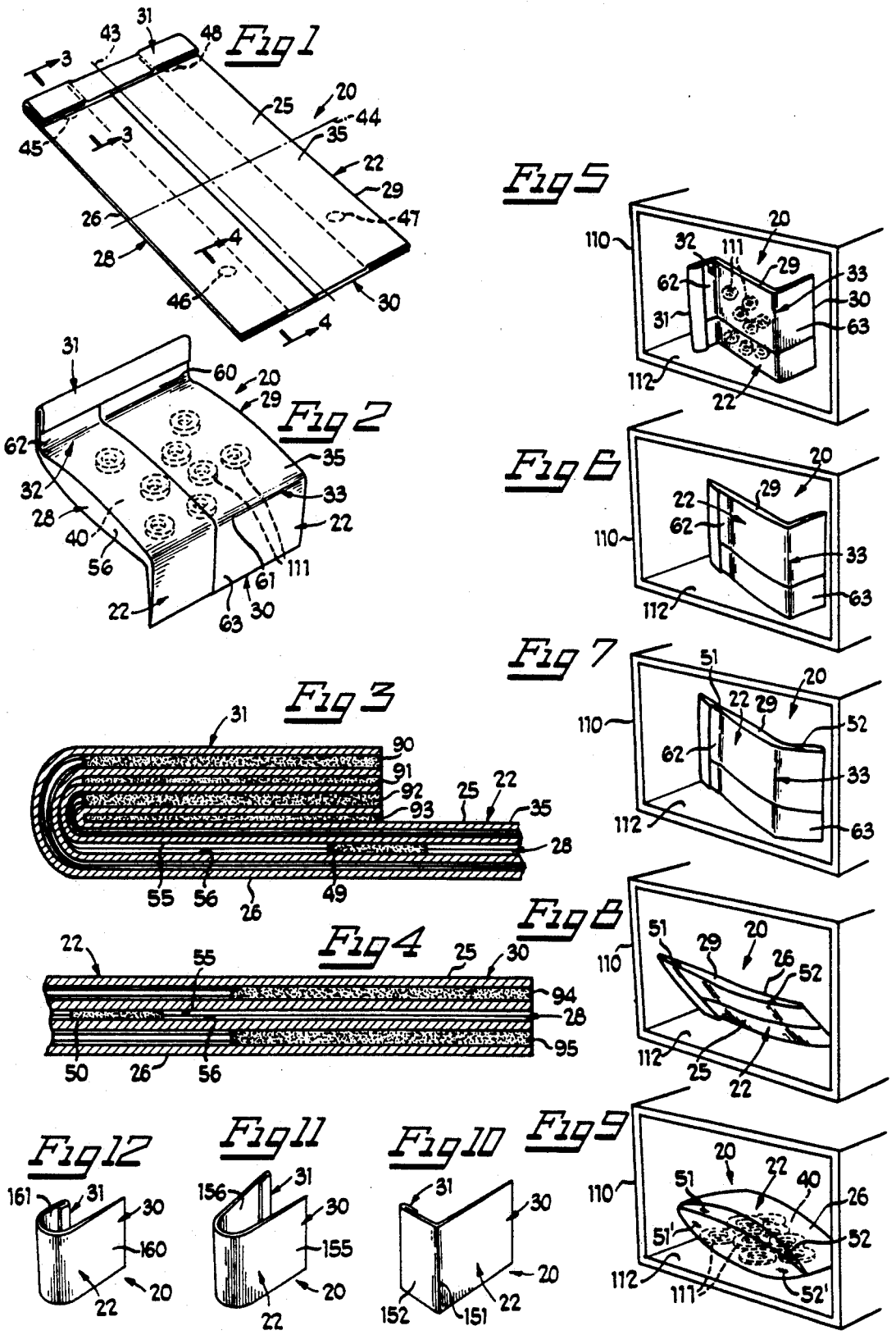
FIG. 1 of the drawings is a top perspective view of the present cooking apparatus showing, in particular, the gusseted side panels, its substantially sealed bottom region, as well as the attachment means positioned between the inner opposing walls of the gusseted side panels.
FIG. 2 of the drawings is a top perspective view of the present cooking apparatus filled with food, showing, in particular, the first and second fold lines positioned near the top and bottom ends, respectively, of the cooking container, the approximately 90 degree positioning of the fold flaps with respect to the longitudinal axis of the cooking container wherein the flaps are folded in directions opposite to each other, as well as showing the expandable food operably positioned within the food containment region of the cooking container prior to actual cooking.
FIG. 3 of the drawings is a fragmentary cross-sectional view of the cooking apparatus of FIG. 1, taken along lines 3—3 and looking in the direction of the arrows and showing in particular, the adhered portions of the front and back panel means, as well as the gusseted side panel means which are attached to each other and folded over to form a substantially sealed bottom region of the cooking container, as well as showing a gusset attachment region operably tacking together opposing portions of the exterior surfaces of the gusseted side panels.
FIG. 4 of the drawings is a fragmentary cross-sectional view of the cooking apparatus of FIG. 1, taken along lines 4—4 and looking in the direction of the arrows and showing in particular, the adhered portions of the front and back panel means and gusseted side panel means which form the substantially sealed top region, as well as showing a gusset attachment region operably tacking together opposing portions of a gusseted side panel.
FIG. 5 of the drawings is an elevated perspective view of the cooking apparatus within an intended cooking environment, specifically, an oven such as a microwave oven, showing in particular, the Z-shaped positioning means used to temporarily position the cooking container means in a first vertically supported orientation within the oven.
FIG. 6 of the drawings is an elevated perspective view of the cooking apparatus within an oven, after heat has been generated therefrom, and accordingly, after one of the bottom fold flaps has become unfolded as a result of such heat and resultant cooking.
FIG. 7 of the drawings is an elevated perspective view of the cooking apparatus within an oven, after extended exposure of heat generated from the oven and, in turn, heat generated from the food being cooked, showing in particular, the initiation of the unfolding of the top fold flap after the bottom fold flap has been unfolded, as well as showing the maintained relatively thin profile of the gusseted side panels.
FIG. 8 of the drawings is an elevated perspective view of the cooking apparatus in an oven, after both the bottom and top fold flaps have become unfolded as the result of the heat generated from the oven as well as from the expanding food being cooked therewithin, and further showing the maintained pinched portions, and accordingly, the relatively thin profile, of the gusseted side panels resulting from the gusset attachment means, and particularly showing the cooking apparatus falling from its first vertically supported orientation into a second fallen orientation.
FIG. 9 of the drawings is an elevated side view of the cooking apparatus in an oven, after it has fallen into its second fallen orientation as the result of gravity, and showing in particular, the expanded area of the food containment region, as well as the forced apart positioning means of the previously attached gusseted side panels.
FIG. 10 of the drawings is an elevated front perspective view of the cooking apparatus showing in particular, the positioning means comprising one fold at a substantially 90 degree angle to the longitudinal axis of the cooking container, so as to form a substantially L-shaped cooking apparatus.
FIG. 11 of the drawings is an elevated front perspective view of the cooking apparatus showing, in particular, the positioning means having a top and bottom fold flap which form a substantially U-shaped cooking apparatus.
FIG. 12 of the drawings is an elevated front perspective view of the cooking apparatus, showing in particular, the positioning means having a top and bottom fold flap which form a substantially J-shaped cooking apparatus.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Cooking apparatus 20 is shown in FIG. 1 as comprising cooking container means 22 which includes front panel means 25, back panel means 26, as shown more clearly in FIGS. 9, 11 and 12, first gusseted side panel means 28, second gusseted side panel means 29, substantially sealable top region 30, substantially sealed bottom region 31, exterior surface 35, and pinched gusseted regions 45 through 48. Pinched gusseted regions 45 through 48 each include gusset attachment means, such as gusset attachment means 49 and 50, as shown in FIGS. 3 and 4, respectively. The pinched gusseted regions, and, in turn, the attachment regions, serve to temporarily maintain portions of opposing inner walls, such as opposing inner walls 55 and 56, as shown in FIGS. 3 and 4, of a corresponding gusseted side panel, such as gusseted side panel 28, together for a predetermined amount of time during actual exposure to heat generated from an oven, such as a microwave oven 110 (FIG. 5), so as to facilitate transition of the cooking container from a first vertically supported orientation (FIGS. 5 through 8) to a second fallen orientation (as shown in FIG. 6).

Container positioning means 32 and 33 are shown in FIG. 2 as respectively comprising first fold line 60 positioned adjacent to sealed bottom region 31 of cooking container means 22, and second fold line 61, positioned near sealed top region 30 of cooking container means. Both fold lines 60 and 61 define a bottom folded flap 62 and a top folded flap 63, respectively, which are each folded at approximately 9 degrees to the longitudinal axis 43 (FIG. 1), and, in substantially parallel relationship to the transverse axis 44 of cooking container means 22. Accordingly, such folded positioning of bottom and top folded flap 62 and 63, respectively, results in cooking apparatus 20 having a substantially Z-shaped configuration. As will be explained in greater detail in FIG. 5, container positioning means 32 and 33, and accordingly, bottom fold flap 62 and top fold flap 63, actually serve to temporarily maintain cooking apparatus 20 in a first vertically supported orientation within oven 110.

Also shown in FIG. 2 is food 111, operably positioned within food containment region 40 prior to initiation of the cooking process, together with sealed top region 30. As can be seen, food 111 only occupies a portion of food containment region 40 before cooking—so as to allow for expansion of the food and resulting food vapors during actual cooking. Such expansion of food is facilitated as a result of the expansion of food containment region 40 which results from internal pressure built up from heat generated from the oven, from the food as it is being cooked. Accordingly, such expansion of food containment region 40 (which expansion is maximized as the result of gusseted side panels 28 and 29), enables relatively unobstructed cooking and expansion of food 111 as it is being cooked. Although food 111 may be capable and/or intended to expand during the cooking process, other types of food which may or may not expand, are also contemplated for cooking within cooking apparatus 20. Furthermore, although not shown, it is additionally contemplated that, alternatively, an enhanced heating susceptor may be applied as shown conventionally in Bohrer '010, or otherwise within the cooking container for intensifying the heat being delivered to the food.

Gusset attachment regions, such as gusset attachment regions 49 and 50, are shown in FIGS. 3 and 4, respectively. As can be seen, the gusset attachment regions are operably positioned between the opposing inner walls, such as opposing inner walls 55 and 56, of a corresponding gusseted side panel means, such as first gusseted side panel means 28 (FIG. 2), so as to pinch, or tack, the associated portions of the opposing inner walls together. These "pinched" regions facilitate transition of cooking apparatus 20 from its first vertically supported orientation (FIG. 5) towards and into its second fallen orientation (FIGS. 8 and 9). While the attachment regions may comprise any suitable commercially available adhesive compound which is safe for use in association with cooking food, other types of attachment means, such as oven safe releasable staples or stitching are also contemplated.

Also shown in FIGS. 3 and 4 respectively are substantially sealed bottom region 31 (FIG. 3), and substantially sealed top region 30 (FIG. 4). Substantially sealed bottom region 31 comprises the bottom end portions of front panel means 25, back panel means 26, and gusseted side panel means, such as first gusseted side panel means 28, being attached together by adhesive, such as adhesive 90 through 93. These adhered end portions are folded over and adhesively attached through adhesive to an adjacent portion of exterior surface 35 of front panel means 25—although such attachment could, alternatively, be secured to a portion of the exterior surface of back panel means 26, if desired.

Substantially sealed top region 30, (FIG. 4), comprises the interior surfaces of adjacently positioned portions of front panel means 25, back panel means 26, first gusseted side panel means 28 and second gusseted side panel means 29 (FIG. 5) being releasably attached to each other by adhesive, such as adhesive 94 and 95. In one embodiment, top region 30 is not sealed through folding over as is bottom region 31, but rather sealed by adhesive between the inner layers of the container. Conventional bag venting means (not shown) may also be utilized at either the top or bottom sealed regions. After food 111 has been fully cooked (FIG. 9) top region 30 can be pulled apart by an individual for access to the cooked food. Commercially available adhesives, which are safe for use with cooking food, are contemplated for such use.

Cooking apparatus 20 is shown in its cooking environment in FIGS. 5 through 9, after food 111 has been operably placed within food containment region 40 (FIG. 3), and after both top and bottom region 30 and 31, respectively, have been sealed, with or without venting means. Cooking container means 22, along with food 111 to be cooked therewithin, is inserted within a conventional oven, such as microwave oven 110, after cooking container means 22 has been operably folded along fold lines 32 and 33—so as to result in a substantially Z-shaped cooking apparatus 20 (FIG. 5). The Z-shaped configuration facilitates positioning of cooking apparatus 20 on its edge in a first vertically supported orientation within oven 110, wherein at least a portion of first gusseted side panel means 29 (FIG. 2) is positioned substantially parallel to bottom oven support 112 of oven 110.

After cooking apparatus 20 has been operably inserted within oven 110, in its first vertically supported orientation, as shown in FIG. 5, the oven is activated, to in turn, start the cooking process. During the initial stages of the cooking process, bottom fold flap 62 begins to unfold (FIG. 6). Such unfolding occurs as the result of build-up of internal food and vapor pressures within food containment region 40 (FIG. 2), caused by heat generated from the oven, as such heat cooks the food. Although bottom fold flap 62 is shown to be the first flap to unfold in FIG. 6, it is contemplated that either fold lines 32 and 33 may unfold first, or, at approximately the same time.

After one fold flap, such as flap 62, has begun to unfold, the other flap, such as top fold flap 63, will begin to unfold (FIG. 7). Indeed, as the cooking process continues, food containment region 40 will continue to expand as the result of the build-up of the internal pressure therewithin, so as to in turn, actually force top fold flap 63, like bottom fold flap 62 into an unfolded position (FIG. 8) so that front and back panels 25 and 26, respectively, will each have a substantially co-planar exterior surface. Although food containment region 40 begins to expand during the unfolding process, gusseted side panels, such as second gusseted side panel 29, are temporarily hindered during such expansion as the result of gusset attachment regions, such as gusset attachment regions 51 and 52, as shown in FIGS. 1, 7 and 8. Such hindered expansion of the gusseted side panels actually serves to facilitate the transition of cooking apparatus 20 from its first vertically supported orientation, as shown in FIG. 5, towards and into its second fallen orientation, as shown in FIG. 8 and FIG. 9—due in part, to the relatively thin gusseted side panel profile which is maintained while such expansion is hindered by the attachment regions. Absent such attachment regions, the gusseted side panels could prematurely over-expand while cooking apparatus 20 is still in its first vertically supported orientation—thereby potentially precluding, or delaying apparatus 20 from falling into its second fallen orientation.

Inasmuch as the gusseted attachment regions maintain the relatively thin profile of the gusseted side panels for a predetermined period of time after the fold flaps have unfolded, such a thin profile will allow cooking apparatus 20 to tip over, as the result of gravity, from its first vertically supported orientation toward and into its second fallen orientation (FIGS. 8 and 9). It is preferred that gusseted attachement regions 45 through 48 (FIG. 1) remain intact until after cooking apparatus 20 has fallen into its second fallen orientation (FIG. 9), and accordingly, after the internal pressure in food containment region 40 has become strong enough to overcome the attachment regions, as also shown in FIG. 9. Such falling imparts agitation to food 111 within food containment region 40, to in turn, enhance the overall cooking uniformity and cooking quality of the food.

Cooking apparatus 20 is shown in FIG. 9 after it has fallen into its second, fallen orientation, after the internal pressure within food containment region 40 has forced apart gusseted attachment means, such as gusseted attachment means 51, 51', 52 and 52', and accordingly after further expansion to the gusseted side panels and food containment region. Accordingly, such expansion, coupled with the agitation to the food which results during the falling over of cooking apparatus 20 into its second fallen orientation, allows food 111 to expand to its intended fully-cooked size. While the type of food to be cooked within cooking apparatus 20 may be of the variety which expands during the cooking process, such as popcorn, cheese rings or pork rinds, other varieties of non-expandable vapor emitting and non-emitting food is also contemplated.

Cooking apparatus 20 is shown in FIGS. 10 through 12 as including three of many alternative positioning means configurations for purposes of temporarily maintaining apparatus 20 in a first vertically supported orientation during the cooking process. Specifically, cooking container means 22 is shown in FIG. 10 as including fold line 151 and fold flap 152. Accordingly, this single fold line 151 results in a cooking apparatus having a substantially L-shaped cooking container means 22. Cooking container means 22 is shown in FIG. 11 as having a first fold flap 155 and a second fold flap 156 so as to result in a cooking apparatus having a substantially U-shaped cooking container means 22. Cooking container means 22 is shown in FIG. 12 as having a first fold flap 160, and a second fold flap 161 so as to create a cooking apparatus 20 having a substantially J-shaped cooking container means 22. Although the positioning means have been configured to show four different shaped cooking apparatuses (including Z-shaped), other configurations such as V-shaped, S-shaped and C-shaped, among others, are also contemplated.

Cooking apparatus 20 is shown in FIG. 13 as including wing-like positioning means 200. Wing-like positioning means 200 includes a bottom side 205 and a bag attachment side 206 (FIG. 14). The wing-like positioning means is temporarily secured in this embodiment to a portion of first gusseted side panel means 28, although it could likewise be attached to second gusseted side panel means 29 or to front and back panel means 25, 26, by position release means 210. Position release means 210 comprises an adhesive operably applied to the mating portions of the wing-like positioning means and the corresponding gusseted side, front or back panel. As can be seen, wing-like positioning means 200 is folded over so that approximately one half of the bag attachment side 206 of the wing is positioned adjacent and parallel to front panel means 25, with the other approximate half of the bag attachment side 206 of the wing being positioned adjacent and parallel to the back panel means 26. Wing-like positioning means 200 is constructed to be manually folded open and deployed prior to placement of apparatus 20 into an oven, so as to temporarily maintain cooking container means 22 in a first vertically supported orientation, as shown in FIG. 14. Accordingly, wing-like positioning means 200 preferably comprises a rigid yet flexible construction such as wire or paper of suitable guage so as to facilitate such restrainable foldability.

Cooking apparatus 200 is shown in FIG. 1 in its first vertically supported orientation within oven 110. This first vertically supported orientation is maintained by manually unfolding wing-like positioning means 200 from its folded position (FIG. 13), into a substantially flat configuration. Accordingly, inasmuch as cooking container means 22 is operably attached to bag attachment side 206 of wing-like positioning means 200, such unfolding enables cooking container means to be propped up and temporarily maintained in a vertically supported position.

Cooking apparatus 20 is shown in FIG. 15 after position release means 210 has begun to fail. Such failing of position release means 210 occurs after its exposure to a predetermined amount of heat generated from oven 110, as well as from the heat generated from the bag containing the food being cooked within food containment region 40. Inasmuch as position release means may comprise adhesive, such failure could result from dissipation, melting and/or evaporation of such adhesive, as well as from forced displacement of cooking container 22 from positioning means 200 as the result of the internal pressure which forces expansion of food containment region 40. Accordingly, once such failure has occurred, cooking container means 22 will begin to fall, as the result of gravity, from its first vertically supported orientation (FIG. 14), towards, and eventually into, its second fallen orientation (FIG. 15), where the fully cooked apparatus and food will assume the shape of apparatus 22 in FIG. 9.

The foregoing description and drawings merely explain and illustrate the invention and the invention is not limited thereto except insofar as the appended claims are so limited as those skilled in the art who have the disclosure before them will be able to make modifications and variations therein without departing from the scope of the invention.

What is claimed is:

1. A cooking apparatus for facilitating the cooking of various types of foods in which at least minimal facilitated agitation of said food is desired during cooking, and, wherein said food is cooked in said cooking apparatus on an oven bottom support, responsive to heat generated from an oven, such as a conventional or microwave oven, said cooking apparatus comprising:

cooking container means having a longitudinal axis, a transverse axis substantially normal thereto, front panel means, back panel means, first side means and second side means positioned substantially opposite to said first side means, said first and second side means each being operably positioned adjacent said front and back panel means, said cooking container means being operably configured to accept and retain food to be cooked therewithin during exposure to said generated heat, said front and back panel means, and said first and second side means each having an exterior surface, an interior surface collectively defining a food containment region, a top end and a bottom end, each of said bottom ends being operably configured so as to form a substantially sealed bottom region, each of said top ends being operably attached to each other so as to form a substantially sealed top region with said food positioned therewithin at least a portion of said food containment region;

container positioning means operably associated with one of said first and second side means of said cooking container means for releasably maintaining said cooking container means in a first vertically supported orientation within said oven in which said one of said first and second side means is substantially juxtaposed to said oven bottom support and the other one of said first and second side means is distally elevated above said oven bottom support, and for alternatively releasing said cooking container means from said first orientation to a second fallen orientation within said oven during cooking within said oven, said container positioning means being capable of releasing said cooking container means from said first vertically supported orientation to said second fallen orientation as a function of heating, and, in turn, cooking generated by said oven, without manual manipulation of said cooking container means during cooking, said container positioning means including position release means for facilitating gravitational movement of said cooking container means from said first vertically supported orientation, said gravitational movement occurring as a result of controlled deterioration of said position release means upon a desired degree of exposure of said position release means to said heat generated from said oven, said gravitational movement of said cooking container means from said first vertically supported orientation to said second fallen orientation causing agitation to said food within said food containment region.

2. The invention according to claim 1 in which said container positioning means comprises at least one fold means operably positioned along the longitudinal axis of one or more portions of said cooking container means, in a position substantially parallel to said transverse axis, so as to maintain said cooking container means in said first vertically supported orientation during at least a desired portion of said cooking, said folded portions of said cooking container means supporting said cooking container means in said first vertically supported orientation.

3. The invention according to claim 2 in which said food containment region and, in turn, said cooking container means expands and unfolds as the result of internal pressure generated therewithin said food containment region during said cooking of said food therewithin, as said food is heated and cooked by said heat generated from said oven, said expansion of said food containment region causing said at least one folded portion to be prompted into an unfolded position, in substantially coplanar alignment with the remaining portion of said cooking container means, to in turn, cause said cooking container means to fall by gravity, from its said first vertically supported orientation to its said second fallen orientation, wherein said movement from said fall further causes agitation to said food within said food containment region for improved continued cooking thereof.

4. The invention according to claim 3 wherein said first vertically supported orientation comprises at least a folded portion of one of said first and second side means being positioned in uprighted abutment with said bottom support of said oven, said second fallen orientation comprising at least a portion of one of said front and back panel means being positioned juxtaposed to the bottom support of said oven.

5. The invention according to claim 4 in which said at least one fold means comprises two distally spaced folds along said longitudinal axis of said cooking container means so as to configure said cooking container means into a substantially Z-shaped cooking apparatus.

6. The invention according to claim 4 in which said at least one fold means comprises at least two distally spaced folds along said longitudinal axis of said cooking container means so as to configure said cooking container means into a substantially U-shaped cooking apparatus.

7. The invention according to claim 4 in which said at least one fold means comprises one fold along said longitudinal axis of said cooking container means so as to configure said cooking container means into a substantially L-shaped cooking apparatus.

8. The invention according to claim 3 in which said first and second side means comprise gusseted panels for further facilitating expansion of said food containment region and the containment of an expanded food quantity therewithin.

9. The invention according to claim 8 in which said gusseted panels comprise one or more releasably pinched gusseted regions operably positioned along at least one of said first and second side panel means so as to facilitate transition of said cooking container means from said first vertically supported orientation to said second fallen orientation, said pinched gusseted regions including gusset attachment means for releasably maintaining said one or more pinched gusseted regions in a substantially narrow orientation to facilitate said gravitational movement to said second fallen orientation, said one or more pinched gusseted regions releasing upon extended exposure to said heat generated from said oven, as well as from said food cooking within said food containment region, after said cooking container means has fallen to said second fallen orientation, to facilitate expansion of said cooking container means after repositioning of same to said second fallen orientation.

10. The invention according to claim 9 in which said releasable gusset attachment means comprise one or more adhesive members operably positioned between a portion of the inner most faces of said gusseted side panels for temporarily maintaining s id pinched gusseted regions in said substantially narrow orientation.

11. The invention according to claim 1 in which said container positioning means comprise one or more support members operably attached to at least one of said first side means, second side means, front panel means and back panel means of said cooking container means so as to facilitate temporary substantially vertical support of said cooking container means in said first vertically supported orientation within said oven.

12. The invention according to claim 11 in which said one or more support members comprise a wing-like member, said position release means comprising failure inducement means operably applied to said one or more wing-like members so as to cause said one or more wing-like members to detach from said cooking container means to enable said cooking container means to fall from said first vertically supported orientation to said second fallen orientation, wherein said falling over causes agitation to said food within said food containment region as a result of heat and cooking generated from said oven.

13. The invention according to claim 12 in which said position release means comprises fallible adhesive means operably applied between said one or more wing-like members and at least one of said first side means, second side means, front panel means and back panel means, said adhesive means operably failing through one of dissipation, melting, evaporation and forced displacement, upon extended exposure to said heat generated from said oven so as to cause said cooking container means to at least partially detach from said one or more wing-like members to, in turn, fall from gravity, from said first vertically supported orientation to said second fallen orientation.

14. The invention according to claim 12 wherein said first vertically supported orientation comprises at least a portion of one of said first and second side means being positioned juxtaposed to said bottom support of said oven, said second fallen orientation comprising at least a portion of one of said front and back panel means being juxtaposed to said bottom support of said oven.

15. The invention according to claim 12 in which said first and second side means comprise gusseted panels for further facilitating the expansion of said food containment region of said cooking container means.

16. The invention according to claim 1 in which the cooking container means further includes inner container liner means operably positioned for exposure to said food containment region so as to preclude moisture and grease absorption by the remaining one or more plies of said cooking container means.

17. The invention according to claim 16 in which said cooking container means includes an outer ply, and said inner container liner means positioned adjacent to said food containment region, wherein said outer ply comprises kraft paper and said inner container liner means comprises a substantially greaseproof material.

18. The invention according to claim 17 in which said inner container liner means and said outer ply are laminated to each other by adhesive bonding along each of said first side means, second side means, front panel means and back panel means.

19. The invention according to claim 1 in which said cooking container means is constructed from a single sheet of twenty-five pound gauge greaseproof paper material.

20. A process for fabricating and utilizing a cooking container for cooking food in an oven having an oven bottom support, which container is of the type having a transverse axis, a longitudinal axis, front and back panels, first and second sides operably attached to said front and back panels, a substantially sealable bottom region, a substantially sealable top region, an exterior surface, an interior surface defined by said front and back panels and said first and second sides to describe a food containment region, and which is further capable of agitating the food while cooking within said oven, to enhance the overall uniformity and quality of the food so cooked, said process for fabricating and utilizing a cooking container for cooking food in an oven comprising the steps of:

filling said cooking container with food operably positioned within at least a portion of said food containment region;

sealing said top and bottom regions of said cooking container so as to preclude the inadvertent release of said food during cooking;

folding said cooking container along one or more folds substantially perpendicular to the longitudinal axis of said cooking container, so as to enable said cooking container to be positioned in a substantially upright vertically supported first orientation within said oven, in which one of said first and second sides is substantially juxtaposed to said oven bottom support and the other one of said first and second sides is distally elevated above said oven bottom support, during a portion of the cooking operation;

applying heat from said oven to said cooking container, and in turn, to said food contained therewithin, while said cooking container is in its said first vertically supported orientation to, in turn, initiate at least partial expansion of said food containment region, and in turn, said cooking container to in turn, substantially unfold said one or more folds, so as to force said food containment region toward assuming a substantially straight co-planar orientation, said assumption of said substantially straight co-planar orientation prompting said cooking container to fall from said substantially upright vertically supported first orientation toward and into a second substantially horizontal fallen orientation in which one of said front and back panels is substantially juxtaposed to said oven bottom support after said one or more folds substantially unfold;

agitating said cooking container as it falls by gravity from said vertically supported orientation towards and into said second substantially horizontal fallen orientation, after said container unfolds so as to, in turn, agitate the food cooking within said food containment region, to in turn, enhance substantial uniformity, and quality, of the food so cooked;

further expanding the cooking container through further application of heat generated from said oven, and, in turn, further cooking of said food until completion of cooking and ultimate complete expansion of said cooking container containing same, and removing said cooking container, and in turn, said cooked food, from said oven.

21. The process according to claim 20 in which said first and second sides of said cooking container include gusseted side panels so as to enable increased expansion of said food containment region during said cooking process.

22. The invention according to claim 21 in which the process further comprises the step of releasably affixing gusseted side panel portions prior to heating the cooking container in said oven, so as to impart and maintain at the edges of said first and second sides relatively thin gusseted side panel profiles, to in turn, facilitate the re-orientation of said cooking container from said first vertically supported orientation to said second fallen orientation after a predetermined amount of said expansion of said food containment region and unfolding of the cooking container during the cooking of said food therewithin.

23. The process according to claim 20 in which the step of positioning one or more folds substantially perpendicular to the longitudinal axis of said cooking container comprises the step of positioning two folds in said cooking container so as to form a substantially Z-shaped cooking apparatus.

24. The process according to claim 20 in which the step of positioning one or more folds substantially perpendicular to the longitudinal axis of said cooking container comprises the step of positioning two folds in said cooking container so as to form a substantially U-shaped cooking apparatus.

25. The process according to claim 20 in which the step of positioning one or more folds substantially perpendicular to the longitudinal axis of said cooking container comprises the step of positioning one fold in said cooking container so as to form a substantially L-shaped cooking apparatus.

26. The process of claim 22 in which said releasably affixed portions of said gusseted side panels detach from one another as a result of further heat generated from said oven and said cooking of said food, after said cooking container has fallen into its second fallen orientation.

* * * * *

UNITED STATES PATENT AND TRADEMARK OFFICE

CERTIFICATE OF CORRECTION

PATENT NO. : 5,244,682

DATED : September 14, 1993

INVENTOR(S) : Thomas W. Happ

It is certified that error appears in the above-identified patent and that said Letters Patent is hereby corrected as shown below:

| | |
|---|---|
| Col. 8, Line 54 | After approximately delete "9" and insert instead -- 90 -- (and remove bold font) |
| Col. 13, Line 33 | After agitation delete "to" and insert instead -- of -- |
| Col. 14, Line 49 | After maintaining delete "s id" and insert instead -- said -- |

Signed and Sealed this

Twelfth Day of April, 1994

*Attest:*

Bruce Lehman

BRUCE LEHMAN

*Attesting Officer*

*Commissioner of Patents and Trademarks*